United States Patent [19]

Vergara et al.

[11] 4,249,742

[45] Feb. 10, 1981

[54] MAGNETIC CARD GAME APPARATUS

[76] Inventors: Hector F. Vergara, 6235 SW. 59th St., Miami, Fla. 33143; Manuel Alfonsin, 1080 W. 53rd Ter., Hialeah, Fla. 33012

[21] Appl. No.: 37,114

[22] Filed: May 8, 1979

[51] Int. Cl.[3] ..... A63F 1/02; A63F 1/14

[52] U.S. Cl. ..... 273/294; 46/240; 273/144 B; 273/295; 273/309

[58] Field of Search ..... 273/1 M, 148 R, 144 R, 273/144 B, 292, 295, 309, 294, 149 R; 46/240

[56] References Cited

U.S. PATENT DOCUMENTS

| | | | |
|---|---|---|---|
| 1,956,099 | 4/1934 | Konigsberg | 273/144 R |
| 2,708,580 | 5/1955 | Hamilton | 273/239 X |
| 4,159,593 | 7/1979 | Miller | 273/1 M X |

FOREIGN PATENT DOCUMENTS

| | | | |
|---|---|---|---|
| 571267 | 12/1957 | Italy | 273/144 B |

*Primary Examiner*—Anton O. Oechsle

*Attorney, Agent, or Firm*—Clarence A. O'Brien; Harvey B. Jacobson

[57] ABSTRACT

A playing board of hollow construction defining a shallow cavity receiving a plurality of playing cards each having magnetic characteristics with the cavity being separated into three concentric areas defined by concentrically spaced boundary walls with the two innermost walls including passages to enable the cards to be moved from one area to the other by the use of a selector movable along the top surface of the playing board. The outermost playing area includes a player viewing window with a sliding cover to enable the cards to be selectively observed or concealed to facilitate playing poker with the game apparatus by using conventional poker playing rules.

9 Claims, 11 Drawing Figures

MAGNETIC CARD GAME APPARATUS

BACKGROUND OF THE INVENTION

1. Field of the Invention

The present invention generally relates to a card game apparatus and more specifically to such an apparatus in which a hollow playing board is provided which has a transparent top cover to enable observation of magnetic playing cards disposed within the cavity in the playing board with the cards being movable through access openings by a selector having a magnet associated therewith and movable along the top surface of the playing board combined with closure gates for the access openings and a sliding cover for a player viewing window to selectively conceal and reveal the cards in position in alignment with the player's viewing window.

2. Disclosure Statement

Game apparatuses utilizing movable game pieces having magnetic characteristics with the game pieces being moved in response to a manipulating device have been known for some time with the following U.S. patents being those known to applicants as relevant to this subject matter:

| | | |
|---|---|---|
| 1,461,833 | J. S. Stansburg | July 10, 1923 |
| 2,720,399 | P. O. Pattyn | Oct. 11, 1955 |
| 3,109,652 | K. T. Strand et al | Nov. 5, 1963 |
| 3,210,080 | S. Rael et al | Oct. 5, 1965 |
| Re. 28,108 | H. E. Lippert | Aug. 6, 1974 |

SUMMARY OF THE INVENTION

An object of the present invention is to provide a magnetic card game apparatus in the form of a playing board having a relatively shallow cavity therein which receives a plurality of playing cards combined with a device for selecting and manipulating the cards from a position above the playing board with the cards and the device for manipulating the cards including a magnet assembly by which the inaccessible cards can be manipulated to a desired location within the cavity.

Another object of the present invention is to provide a magnetic card game apparatus in accordance with the preceding object in which the playing board cavity is divided into concentric areas by concentrically spaced walls with the inner walls including passageways or openings selectively closed by movable gates operable from above the playing board.

A further object of the invention is to provide a magnetic card game apparatus in which the circumference of the playing board is provided with a plurality of player positions or stations with each player position including a viewing window and a sliding cover to enable selective observation of the cards positioned under or in alignment with the viewing window thereby enabling the game apparatus to be used in playing conventional poker games.

Still another object of the present invention is to provide a magnet card game apparatus in accordance with the preceding objects in which the cards are preferably circular and provided with a magnet or magnets attached thereto or embedded therein with indicia on at least one surface of the cards which can be observed through transparent areas of the top wall of the playing board.

Yet another object of the invention is to provide a magnetic card apparatus which can vary in shape and configuration and is relatively simple in construction, easy to use and adapted for playing various card games without the players actually coming into contact with and handling the cards.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 7:
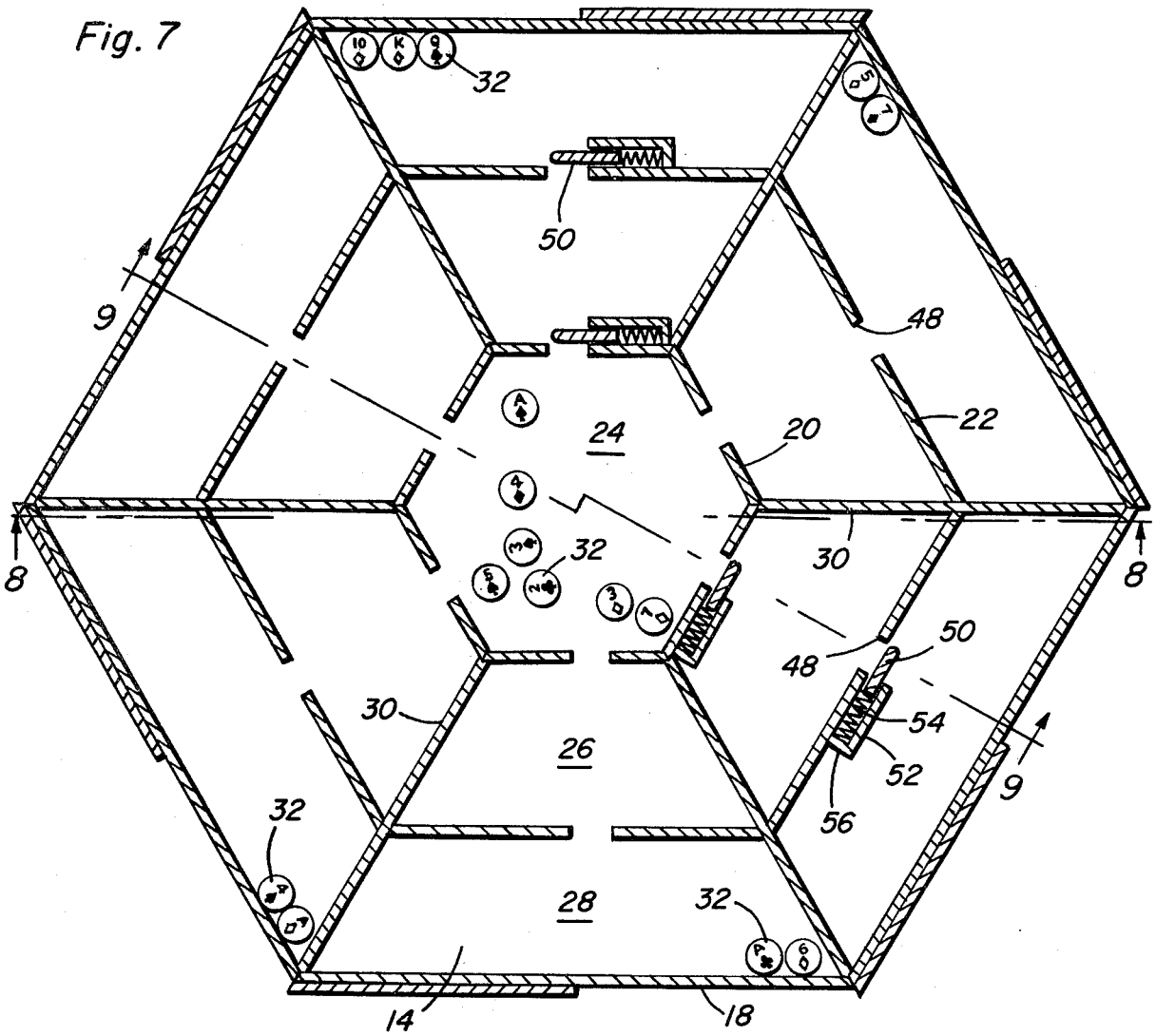
FIG. 7 is a horizontal, plan sectional view taken substantially upon a plane passing along section line 7—7 of FIG. 2 illustrating the internal construction of the playing board.
Figure 8:
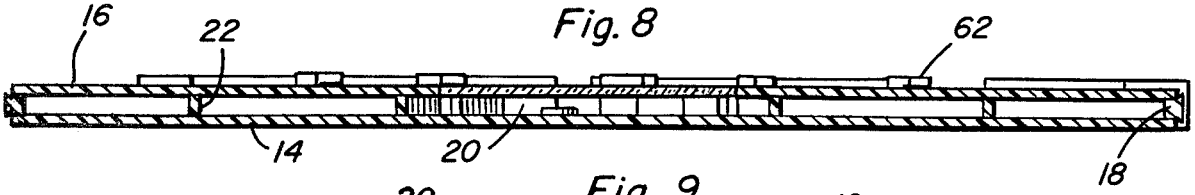
FIG. 8 is a transverse, sectional view taken substantially upon a plane passing along section line 8—8 of FIG. 7 illustrating further structural details of the playing board.
Figure 9:
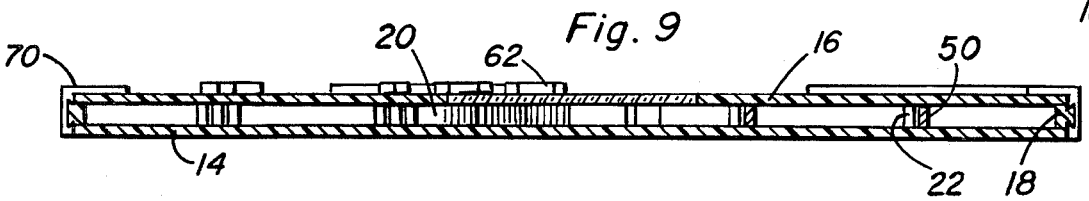
FIG. 9 is a transverse, sectional view taken substantially upon a plane passing along section line 9—9 on FIG. 7 illustrating additional structural details of the playing board.

The magnetic card game apparatus of the present invention includes a playing board generally designated by the numeral 12 generally in the form of a shallow tray-like structure that includes a bottom wall or panel 14, a top wall or panel 16 vertically spaced therefrom and in parallel relation thereto with a circumferential or peripheral wall 18 spacing the peripheral edges of the top and bottom walls thereby defining a shallow cavity interiorly of the playing board. In addition to the peripheral wall 18, a pair of concentrically arranged and concentrically spaced boundary walls 20 and 22 interconnect the top and bottom walls and divide the cavity into a central wild card area 24, an intermediate deck area 26 and an outer playing area 28 as illustrated in FIG. 7. Also interconnecting the top and bottom walls is a plurality of radially extending walls 30 which extend from the inner boundary wall 20 outwardly in intersecting relation to the outer boundary wall 22 and to the peripheral wall 18 as illustrated in FIG. 7. All of these components are rigidly constructed of rigid material, such as plastic or the like although other materials may be utilized if desired. Also, as illustrated in the drawings, the playing board is polygonal and is in the form of a hexagon with the radial walls 30 being oriented at the apices of the hexagonal walls 20, 22 and 18 and dividing the playing area 28 and the deck area 26 into six player positions or stations peripherally of the playing board. While a hexagonal configuration has been illustrated, it is pointed out that the geometrical shape of the playing board may vary. For example, the playing board may be circular, square, rectangular or of any desired configuration which enables the board to be separated into playing stations or positions around the periphery thereof.

Figure 1:
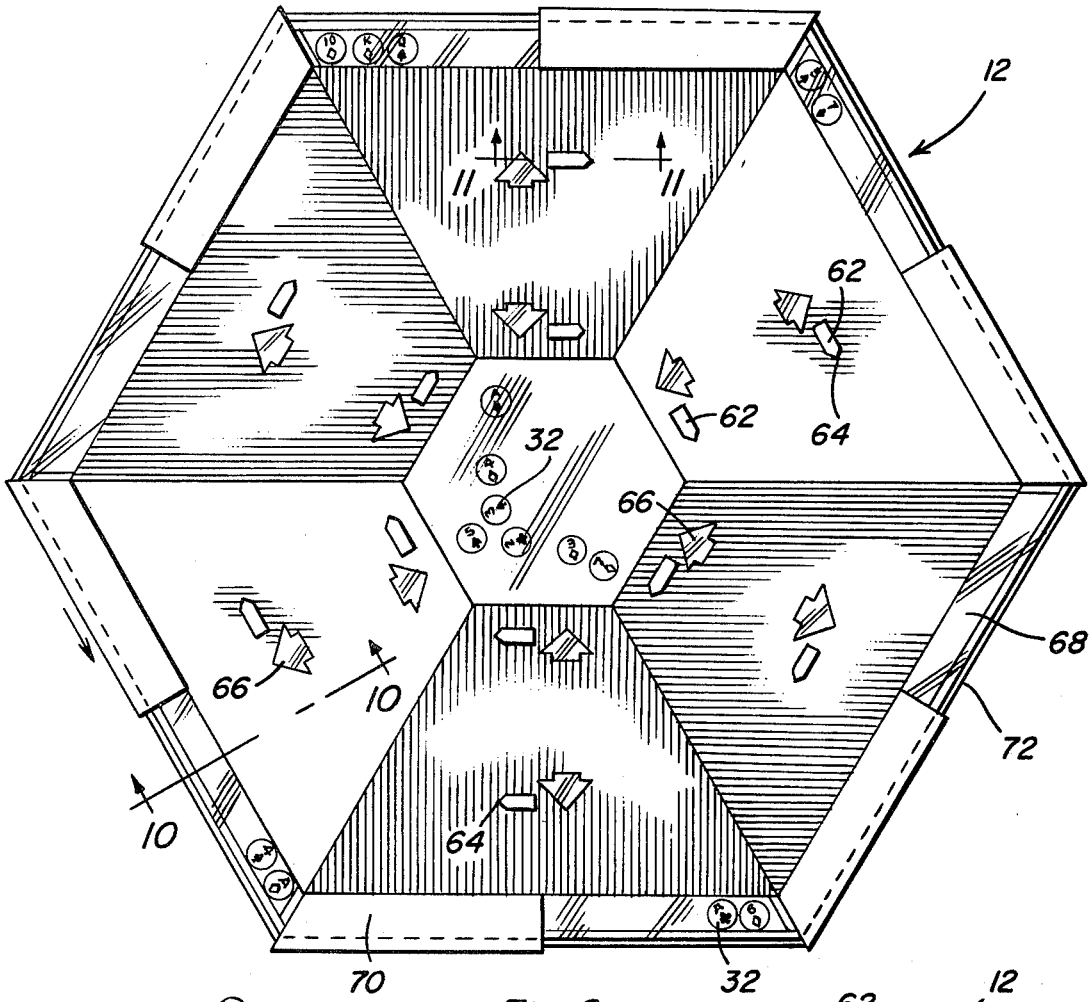
FIG. 1 is a plan view of the magnetic card game apparatus of the present invention.
Figure 2:
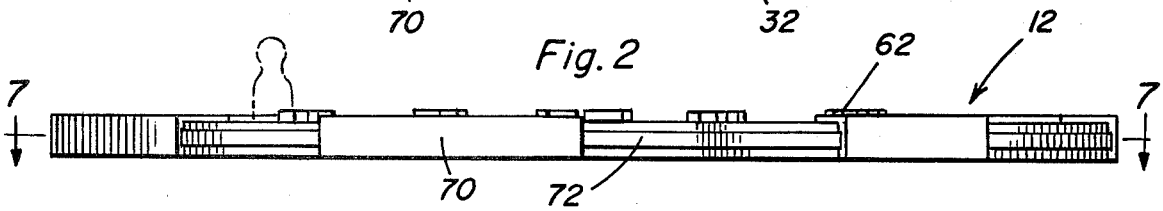
FIG. 2 is a side elevational view of the apparatus.
Figure 3:
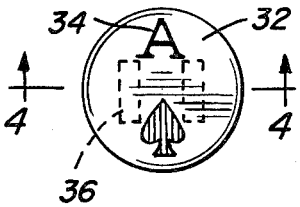
FIG. 3 is a plan view of one of the cards.
Figure 4:
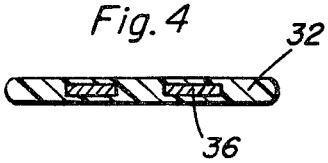
FIG. 4 is a transverse, sectional view, on an enlarged scale, taken substantially upon a plane pass along sectional line 4—4 of FIG. 3 illustrating the structural details of the card.

Disposed within the shallow cavity is a plurality of circular cards 32 which have indicia 34 printed on or otherwise formed on the upwardly facing surface thereof to identify the cards with this indicia being the same as that employed on a conventional deck of cards. The cards 32 may be constructed of thin plastic material as illustrated in FIGS. 3 and 4 with a pair of generally parallel, spaced permanent bar magnets 36 embedded therein. The card may also be constructed of other material such as heavy card board or the like in which the magnets may be laminated between layers thereof or otherwise secured to the cards.

Figure 5:
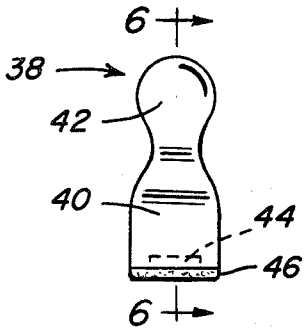
FIG. 5 is a side elevational view of a selector used to manipulate the cards from a point above the playing board.
Figure 6:
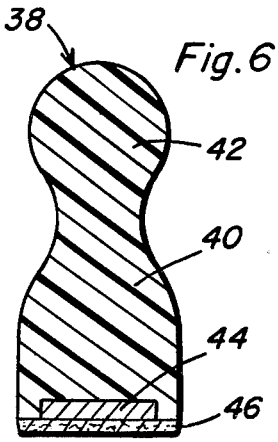
FIG. 6 is a vertical sectional view, on an enlarged scale, taken substantially upon a plane passing along section line 6—6 of FIG. 5 illustrating further structural details of the selector.

The cards are movable in the cavity by the use of a selector generally designated by the numeral 38 and illustrated in FIGS. 5 and 6 with the selector including a generally cylindrical body 40 having a knob-like handle 42 formed on the upper end thereof and a permanent bar magnet 44 embedded in the lower end thereof as illustrated in FIG. 6. The bottom end of the body 40 is provided with a covering of felt 46 or other material to enable the selector 38 to move along the upper surface of the playing board 12 without scratching or marring that surface. The selector 38, when positioned adjacent the top wall of the playing board and in alignment with one of the cards will move the card in the cavity within the playing board without the selector actually coming into contact with the card, thereby enabling the players to manipulate and select cards without actually having access to or coming into contact with the cards.

Figure 11:
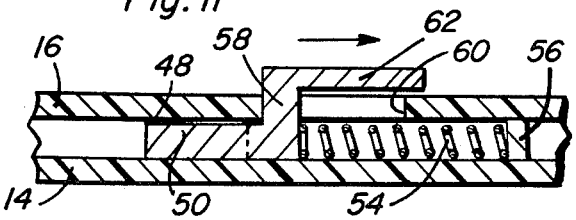
FIG. 11 is a fragmental sectional view, on an enlarged scale, taken substantially upon a plane passing along section line 11—11 of FIG. 1 illustrating specific structural details of the sliding gate assembly associated with the access openings in the boundary walls.

To enable movement of the cards to any area of the cavity, the boundary walls 20 and 22 are provided with openings or passageways 48 therethrough to communicate each segment of the wild card area with each segment of the deck area and each segment of the deck area with each segment of the playing area which enables the cards to be positioned in any area desired in the cavity. Each of the passages or openings 48 is provided with a slidable gate 50 positionable alongside of the external surface of the boundary wall adjacent the opening 48 with the gate 50 being slidably guided by a guide and retainer wall 52 paralleling the boundary wall. A compression spring 54 is also retained in position by the wall 52 and one end of the spring 54 engages an end wall 56 extending between the retainer wall 52 and the adjacent portion of the boundary wall with the other end of the spring 54 engaging the end of the gate 50 thus biasing the gate 50 to a position forming a closure for the opening or passage 48. The end of the gate 50 engaged by the spring 54 includes an upright post or offset portion 58 which extends upwardly through a slot 60 formed in the top wall 16 as illustrated in FIG. 11 to limit and guide movement of the gate 50. The upper end of the post 58 includes a gate actuator 62 paralleling and closely overlying the top wall 16 with the free end of the gate actuator 62 being pointed as at 64 to form a directional arrow to indicate the direction in which the actuator 62 should be moved to open the gate. As illustrated in FIG. 11, the post 50, post 58 and gate actuator 62 generally define a z-shaped member which is slidably guided and spring biased to a closed position. Also, the top wall 16 is provided with indicia 66 in the form of an arrow adjacent each of the gates indicating the directional movement of the cards through the opening or passageway.

Figure 10:
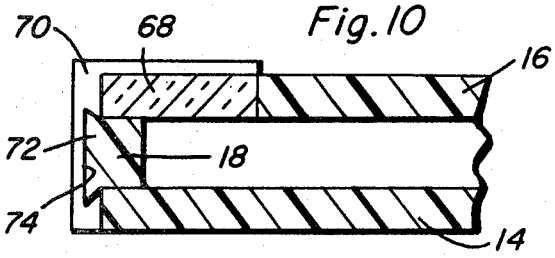
FIG. 10 is a fragmental sectional view, on an enlarged scale, taken substantially upon a plane passing along section line 10—10 of FIG. 1 illustrating the structural details of the viewing window and slide cover associated therewith.

Each segment of the playing area 28 is provided with a transparent player viewing window 68 forming a portion of the top wall 16 as illustrated in FIG. 10 and a sliding opaque cover 70 is provided for movement along the outer edge of the playing area segment to selectively reveal and conceal the cards 32 disposed under the player viewing window. The sliding cover 70 is of right angular configuration with the upper panel overlying the player viewing window 68 and the vertical panel disposed alongside of the peripheral wall 18 which includes a longitudinally extending outward projection or tongue 72 which includes diverging top and bottom edges slidably received in a correspondingly shaped groove 74 in the inner surface of the vertical flange of the sliding cover 70 as illustrated in FIG. 10 so that the sliding cover 70 may be moved longitudinally along the outer edge of each playing area segment from a position revealing the cards 32 under the player viewing window 68 to a position for concealing such cards thereby enabling various types of conventional poker games to be played by utilizing regular rules of play of a poker game.

The number of players is limited only by the shape and size of the playing board. The magnetic cards are enclosed face up in the cavity with the height of the cavity being such that the cards cannot be inverted regardless of how the playing board is handled. A player has access to any card in the deck area 26 and can draw it by using the selector 38 and moving it into his playing area 28 through an appropriately opened access gate. Once a card has been drawn by a player, he can view it in his viewing window and cover it with the sliding cover in his playing area to avoid having it seen by the other players. The wild card window defined by a transparent portion of the top wall 16 enables all of the players to view any cards designated as wild cards. The remainder of the playing board has the top wall thereof separated into areas which are distinguishably colored to indicate the segment of the top which is designated as each player position or station. It is pointed out that in FIG. 7, each of the openings in a boundary wall be provided with an appropriate gate and, if desired, supporting structures could be provided on the bottom wall to support and stabilize the playing board for use on various supporting surfaces.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A magnetic card game apparatus comprising a hollow playing board having a shallow cavity disposed interiorly thereof, a plurality of cards movably disposed in the cavity, a selector means disposed exteriorly of the board for manipulation by the players, said cards and selector means including cooperative magnetic means to enable cards within the cavity to be manipulated by moving the selector means along the surface of the playing board, said playing board including a top wall having at least one area thereof transparent to enable observation of the cards, said cavity being divided into a plurality of concentrically arranged areas by concentrically spaced walls with the inner wall defining a central area, an intermediate wall and an outer wall defining concentric intermediate and outer areas, the inner wall and the intermediate wall including passages enabling cards to be moved between the areas.

2. The structure as defined in claim 1 wherein each of said passages includes a closure gate movable between a position closing the passage to a position opening the passage, each gate being spring biased to a closed position and including a gate actuator extending upwardly through a slot in the top wall of the playing board.

3. The structure as defined in claim 2 wherein the transparent area in the top wall of the playing board is disposed along the periphery of the top wall, and a sliding cover mounted on the playing board to selectively overlie the transparent area to selectively reveal the cards underlying the transparent area.

4. The structure as defined in claim 3 wherein said cavity is divided into a plurality of radially extending segments by radial walls to define player stations.

5. The structure as defined in claim 4 wherein each of the cards is circular in configuration and provided with indicia on the upper surface thereof with the depth of the cavity being inadequate to enable the cards to be inverted within the cavity, said magnetic means including a magnet upon the selector means and a magnet on each card to enable the cards to be drawn by the players for playing poker.

6. The structure as defined in claim 1 wherein said cavity is divided into a plurality of radially extending segments by radial walls to define player positions, said radial walls extending from the inner wall to the outer wall thus leaving the central area of the cavity free of obstructions and adapted to receive wild cards with the central area including a transparent top wall to enable observation of the wild cards.

7. The structure as defined in claim 1 wherein each of the cards having a minimum width dimension greater than the depth of the cavity thereby preventing the cards from being inverted within the cavity, each of said cards being provided with indicia on the upper surface thereof, said magnetic means including a magnet on the selector means and a magnet on each card to enable the cards to be manipulated by movement of the selector means.

8. A magnetic card game apparatus comprising a hollow playing board having a shallow cavity disposed interiorly thereof, a plurality of cards movably disposed in the cavity, a selector means disposed exteriorly of the board for manipulation by the players, said cards and selector means including cooperative magnetic means to enable cards within the cavity to be manipulated by moving the selector means along the surface of the playing board, said playing board including a top wall having at least one area thereof transparent to enable observation of the cards, said cavity being divided into a plurality of player stations by concentrically spaced walls and a plurality of radially disposed walls, the inner wall defining a central undivided area, said inner wall including passages enabling cards to be moved between the central area and the player stations.

9. The structure as defined in claim 8 wherein each of said passages includes a closure gate movable between a position closing the passage to a position opening the passage, and means enabling manual operation of each gate from exteriorly of the playing board.

* * * * *